US011340548B2

(12) United States Patent
Suzuki

(10) Patent No.: US 11,340,548 B2
(45) Date of Patent: May 24, 2022

(54) IMAGE FORMING APPARATUS CAPABLE OF SELECTING EITHER DISPLAY OR NOT DISPLAY REMAINING AMOUNT OF TONER

(71) Applicant: BROTHER KOGYO KABUSHIKI KAISHA, Nagoya (JP)

(72) Inventor: Takashi Suzuki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/008,751

(22) Filed: Sep. 1, 2020

(65) Prior Publication Data

US 2021/0072692 A1 Mar. 11, 2021

(30) Foreign Application Priority Data

Sep. 11, 2019 (JP) ..... JP2019-165467

(51) Int. Cl.
*G03G 15/00* (2006.01)
*G03G 15/08* (2006.01)

(52) U.S. Cl.
CPC ..... *G03G 15/556* (2013.01); *G03G 15/0856* (2013.01)

(58) Field of Classification Search
None
See application file for complete search history.

(56) References Cited

U.S. PATENT DOCUMENTS 5,572,292 A * 11/1996 Chatani ..... G03G 21/1889 399/25
10,782,632 B1 * 9/2020 Aoki ..... G03G 15/5079
2002/0002480 A1 1/2002 Sato et al.
2002/0131784 A1 9/2002 Takemoto
2002/0143893 A1 10/2002 Nakazono et al.
(Continued)

FOREIGN PATENT DOCUMENTS

JP 6-19599 A 1/1994
JP 2001-297237 A 10/2001
(Continued)

OTHER PUBLICATIONS

International Search Report and Written Opinion issued in corresponding International Patent Application No. PCT/JP2020/032663, dated Nov. 17, 2020.

*Primary Examiner* — Jas A Sanghera
(74) *Attorney, Agent, or Firm* — Merchant & Gould P.C.

(57) ABSTRACT

An image forming apparatus includes an apparatus body, a display, a consumable cartridge and a controller. The consumable cartridge is attached to the apparatus body. The consumable cartridge includes a housing and a consumable product memory. The housing accommodates consumable material therein for use in image formation. The consumable product memory stores a first flag. The first flag indicates whether consumable material information indicating that an amount of the consumable material is reduced to a level equal to or less than a first threshold value is displayed or not displayed on the display. The controller is configured to execute a first display process for determining whether the consumable material information is displayed on the display in accordance with indication of the first flag stored in the consumable product memory.

10 Claims, 10 Drawing Sheets

(56) References Cited

U.S. PATENT DOCUMENTS

| | | | | |
|---|---|---|---|---|
| 2003/0040984 | A1 | 2/2003 | Inami et al. | |
| 2004/0208660 | A1* | 10/2004 | Ito | G03G 15/553 399/27 |
| 2006/0204250 | A1 | 9/2006 | Ishihara et al. | |
| 2006/0228123 | A1 | 10/2006 | Zaima | |
| 2008/0316533 | A1 | 12/2008 | Kawai | |
| 2009/0028582 | A1 | 1/2009 | Okamura et al. | |
| 2018/0072064 | A1 | 3/2018 | Kiyohara | |

FOREIGN PATENT DOCUMENTS

| | | | |
|---|---|---|---|
| JP | 2002-149019 | A | 5/2002 |
| JP | 2002-278379 | A | 9/2002 |
| JP | 3501790 | B2 | 3/2004 |
| JP | 3796903 | B2 | 7/2006 |
| JP | 2006-267601 | A | 10/2006 |
| JP | 3890204 | B2 | 3/2007 |
| JP | 3902928 | B2 | 4/2007 |
| JP | 2007-268739 | A | 10/2007 |
| JP | 4042899 | B2 | 2/2008 |
| JP | 4109486 | B2 | 7/2008 |
| JP | 2008-257081 | A | 10/2008 |
| JP | 2008-271231 | A | 11/2008 |
| JP | 4393416 | B2 | 1/2010 |
| JP | 2010-54998 | A | 3/2010 |
| JP | 4582121 | B2 | 11/2010 |
| JP | 4895322 | B2 | 3/2012 |
| JP | 2015-79203 | A | 4/2015 |
| JP | 5755982 | B2 | 7/2015 |
| JP | 5832776 | B2 | 12/2015 |
| JP | 2017-74744 | A | 4/2017 |
| JP | 2018-39225 | A | 3/2018 |

* cited by examiner

FIG. 4A

TONER MEMORY MAP

| ADDRESS | CONTENTS | VALUES | AT THE TIME OF SHIPMENT FROM COMPANY |
|---|---|---|---|
| 1 | COLOR | 1 : BK, 2 : YL, 3 : MZ, 4 : CY | EITHER ONE OF 1 TO 4 |
| 2 | CUMULATIVE DOT COUNT | 0～0xFFFFFFFF | 0 |
| 3 | CUMULATIVE PRINT NUMBER | 0～0xFFFFFFFF | 0 |
| 4 | CUMULATIVE NUMBER OF ROTATIONS OF DEVELOPING ROLLER | 0～0xFFFFFFFF | 0 |
| 5 | 1st FLAG F1 (TONER LOW DISPLAY/ NON-DISPLAY FLAG) | 0 : NOT DISPLAY "TONER LOW"<br>1 : DISPLAY "TONER LOW" | 1 |
| 6 | 2nd FLAG F2 (FLAG INDICATING WHETHER SUPPLY CONTRACT EXISTS) | 0 : SUPPLY CONTRACT DOES NOT EXIST<br>1 : SUPPLY CONTRACT EXISTS | EITHER 0 OR 1 |
| 7 | 3rd FLAG F3 (WHETHER TONER CARTRIDGE HAS BEEN ORDERED) | 0 : NOT HAVING ORDERED<br>1 : HAVING ORDERED | 0 |
| 8 | 4th FLAG F4 (NEW PRODUCT FLAG) | 0 : USED PRODUCT<br>1 : NEW PRODUCT | 1 |
| 9 | CONTRACTOR ID | 0～0xFFFFFFFF | 0 |

FIG. 4B

MAIN BODY MEMORY MAP

| ADDRESS | CONTENTS | VALUES | AT THE TIME OF SHIPMENT FROM COMPANY |
|---|---|---|---|
| 1 | SERIAL NUMBER | 0～0xFFFFFFFF | NUMBER SPECIFIC TO MAIN BODY |
| 2 | 3rd FLAG F3 (WHETHER TONER CARTRIDGE HAS BEEN ORDERED) | 0 : NOT HAVING ORDERED<br>1 : HAVING ORDERED | 0 |
| 3 | CONTRACTOR ID | 0～0xFFFFFFFF | 0 |

IMAGE FORMING APPARATUS CAPABLE OF SELECTING EITHER DISPLAY OR NOT DISPLAY REMAINING AMOUNT OF TONER

CROSS REFERENCE TO RELATED APPLICATION

This application claims priority from Japanese Patent Application No. 2019-165467 filed Sep. 11, 2019. The entire content of the priority application is incorporated herein by reference.

TECHNICAL FIELD

The present disclosure relates to an image forming apparatus to which a consumable cartridge is attached.

BACKGROUND

Prior art discloses an image forming apparatus to which attachable is a consumable cartridge. Such an image forming apparatus is connected via a network to an information processing apparatus serving as a consumable cartridge ordering system. The image forming apparatus is monitoring whether the consumable material contained in the cartridge is reduced to a predetermined amount level. When the consumable material contained in the cartridge is reduced to the predetermined amount level, an order is sent for purchasing purpose to the information processing apparatus. With such a system, a new cartridge is automatically delivered to the user with no order sent by the user.

According to the consumable cartridge ordering system disclosed in the prior art, whether information about the amount of consumable material contained in the cartridge is to be displayed or not to be displayed cannot be determined for each of the cartridges.

SUMMARY

In view of the foregoing, it is an object of the disclosure to provide an image forming apparatus capable of determining either displaying or not displaying information about the amount of toner remaining in the cartridge on a cartridge-to-cartridge basis.

In order to attain the above and other objects, according to one aspect, the disclosure provides an image forming apparatus including an apparatus body, a display, a consumable cartridge and a controller. The consumable cartridge is attached to the apparatus body. The consumable cartridge includes a housing and a consumable product memory. The housing accommodates consumable material therein for use in image formation. The consumable product memory stores a first flag. The first flag indicates whether consumable material information indicating that an amount of the consumable material is reduced to a level equal to or less than a first threshold value is displayed or not displayed on the display. The controller is configured to execute a first display process for determining whether the consumable material information is displayed on the display in accordance with indication of the first flag stored in the consumable product memory.

BRIEF DESCRIPTION OF THE DRAWINGS

The particular features and advantages of the embodiment as well as other objects will become apparent from the following description taken in connection with the accompanying drawings, in which:

FIG. 4A shows a toner memory map, and

FIG. 4B an apparatus body memory map;

DETAILED DESCRIPTION

Next, one embodiment in present disclosure will be described while referring to the accompanying drawings.

Figure 1:
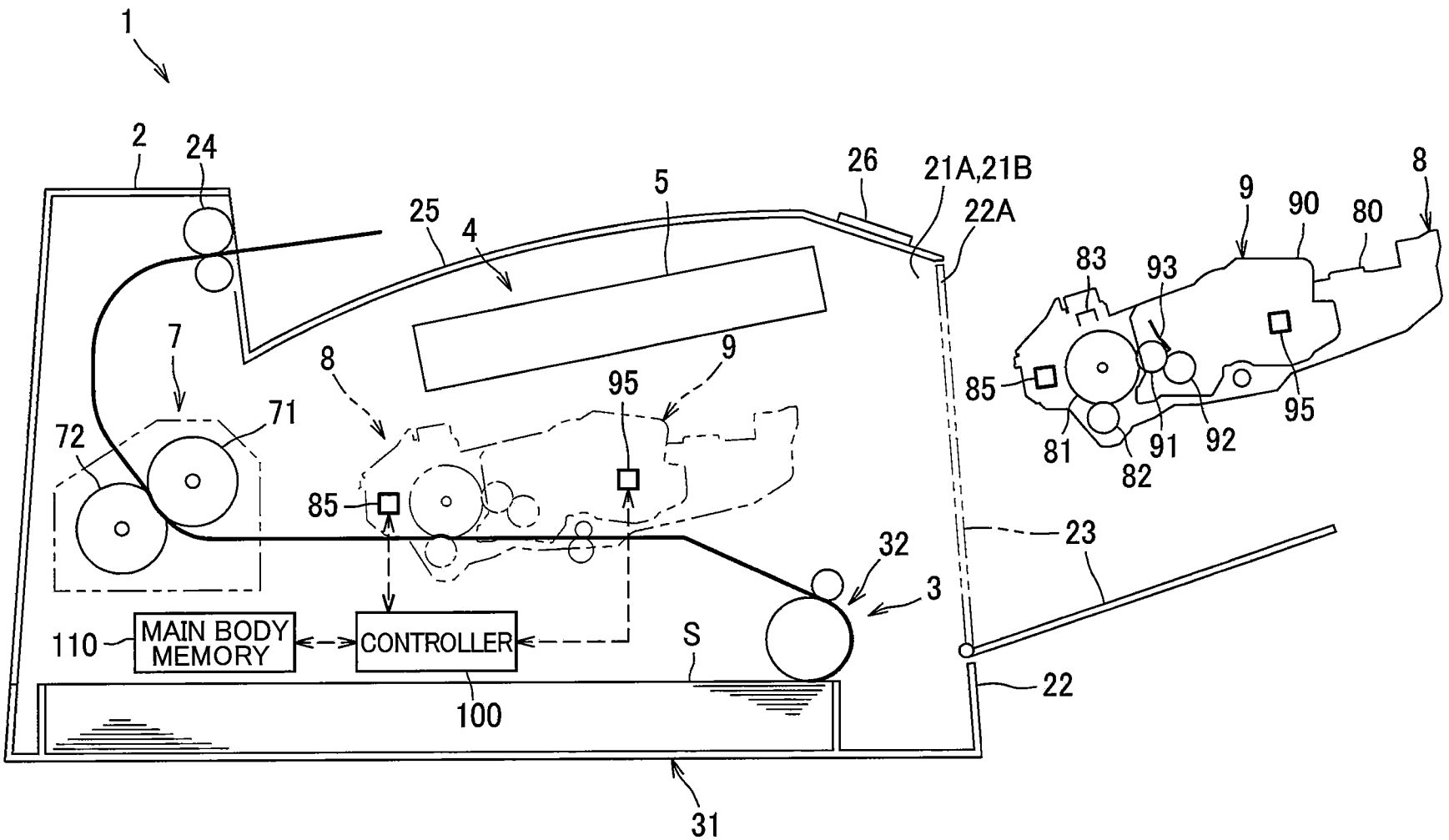
FIG. 1 is a schematic cross-sectional view showing one embodiment of an image forming apparatus.

As shown in FIG. 1, a monochromatic laser printer is illustrated as an example of an image forming apparatus 1. The image forming apparatus 1 includes an apparatus body 2, a feeder part 3, an image forming part 4, a controller 100, an apparatus body memory 110, and a display 26.

The apparatus body 2 is a case formed into a hollow shape. The apparatus body 2 has two side walls 21A and 22B disposed to face each other, and a front wall 22 bridged between the side walls 21A and 22B. The front wall 22 is formed with a main body opening 22A. A cover 23 is provided in the front wall 22 for opening and closing the main body opening 22A. The cover 23 is configured to open and close the main body opening 22A in the case of replacing a consumable item.

The feeder part 3 has a supply tray 31 and a supply mechanism 32. The supply tray 31 is detachably provided in the lower portion of the apparatus body 2. The supply mechanism 32 is configured to supply a sheet stacked in the supply tray 31 toward the image forming part 4.

The image forming part 4 includes a scanner unit 5, a fixing device 7, a drum cartridge 8, and a toner cartridge 9. The scanner unit 5 is disposed in the upper portion of the apparatus body 2 and includes a laser emitting section, a polygon mirror, a lens, and a reflection mirrors, which are not illustrated in the drawing. The scanner unit 5 irradiates a laser beam onto the surface of a photosensitive drum 81 (to be described later) by way of high-speed scanning.

The controller 100 is, for example, a CPU (processor). The image forming apparatus 1 includes an apparatus body memory 110. The apparatus body memory 110 is configured, for example, from a RAM and/or an EEPROM. The controller 100 executes an arithmetic operation based on information about the attached cartridge and programs/data stored in the RAM and ROM, thereby carrying out a print control. The CPU is electrically connected to the RAM, ROM, EEPRAM, a drum memory 85 and a toner memory 95 (the latter two will be described later).

The display section 26 is positioned in the outer surface of the apparatus body 2. The display section 26 displays various kinds of messages thereon based on instructions received from the controller 100.

The drum cartridge 8 is disposed between the feeder section 3 and the scanner unit 5. The drum cartridge 8 is attachable to and detachable from the apparatus body 2. Specifically, the drum cartridge 8 is inserted into the apparatus body 2 through the main body opening 22A opened and closed by the cover 23 of the apparatus body 2, and also the drum cartridge 8 is detachable from the apparatus body 2.

Figure 2:
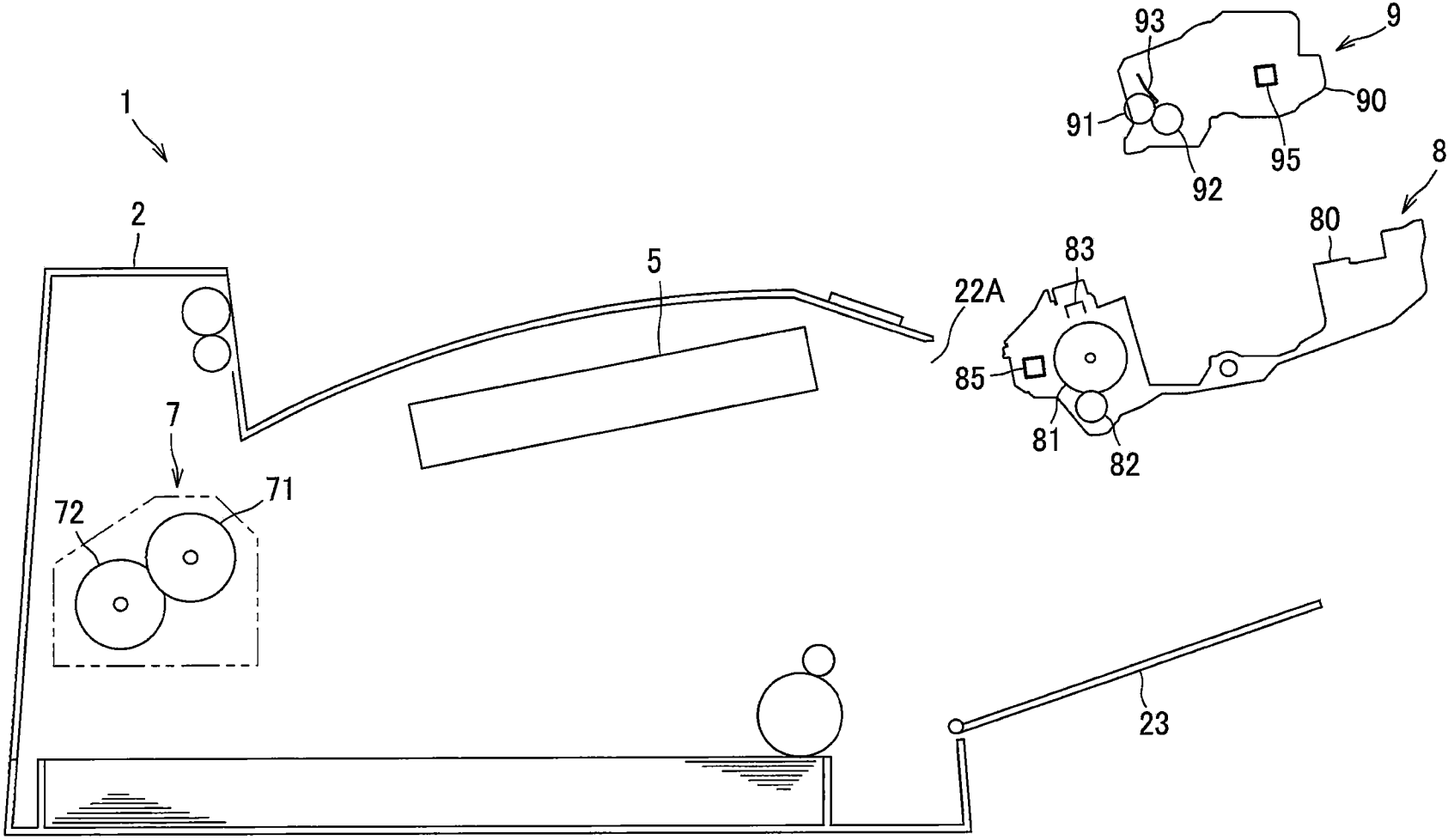
FIG. 2 is a schematic cross-sectional view showing the image forming apparatus in which a developing cartridge and a drum cartridge are removed from an apparatus body.

As shown in FIG. 2, the toner cartridge 9 is capable of inserting into and attached to the apparatus body 2. In this embodiment, the toner cartridge 9 is attachable to and detachable from the drum cartridge 8. The toner cartridge 9 and the drum cartridge 8 are assembled and the resultant assembly is inserted into and attached to the apparatus body 2. It should be noted that the toner cartridge 9 is one example of the consumable cartridge.

Referring back to FIG. 1, the drum cartridge 8 includes a frame 80, the photosensitive drum 81, a transfer roller 82, a charger 83, and the drum memory 85. The frame 80 is configured to mount the toner cartridge 9 thereon. Both the photosensitive drum 81 and the transfer roller 80 are rotatably supported on the frame 80.

The drum memory 85 is a medium that stores information of the drum cartridge 8. The drum memory 85 is, for example, an IC chip, but is not limited to the IC chip.

The toner cartridge 9 includes a housing 90, a developing roller 91, a supply roller 92, a blade 93, and the toner memory 95. The housing 90 accommodates toner therein. Toner is one example of the consumable material used for forming images. The developing roller 91 supplies toner onto the developing drum 81. The supply roller 92 supplies toner accommodated in the housing 90 to the developing roller 91. The blade 93 regulates the layer thickness of toner supplied to the developing roller 91.

The toner memory 95 is a medium that stores information of the toner cartridge 9. The toner memory 95 is, for example, an IC chip, but is not limited to the IC chip.

In this drum cartridge 8, the surface of the rotating photosensitive drum 81 is uniformly charged by the charger 83. Thereafter, the surface of the photosensitive drum 81 is partially exposed to the high-speed scanning laser beam emanating from the scanner unit 5, thereby causing the electrical potential in the exposed portion where exposed to lower and forming an electrostatic latent image on the surface of the photosensitive drum 81 based on image data.

Next, the rotating developing roller 91 supplies toner accommodated in the toner cartridge 9 to the photosensitive drum 81 to thereby form a toner image on the surface of the photosensitive drum 81. Thereafter, the toner image carried on the surface of the photosensitive drum 81 is transferred onto the sheet S having conveyed to a nip between the photosensitive drum 81 and the transfer roller 82.

The fixing device 7 includes a thermal roller 71 and a pressure roller 2. The pressure roller 72 is disposed to oppose and pressurize the thermal roller 71. The fixing device 7 operates to thermally fix the toner transferred to the sheet S while the sheet S passes through the nip between the thermal roller 71 and the pressure roller 72.

The sheet S with toner thermally fixed by the fixing device 7 is conveyed toward a discharge roller 24 disposed downstream of the fixing device 7 and then discharged out onto a discharge tray 25 through the discharge roller 24.

Figure 3:
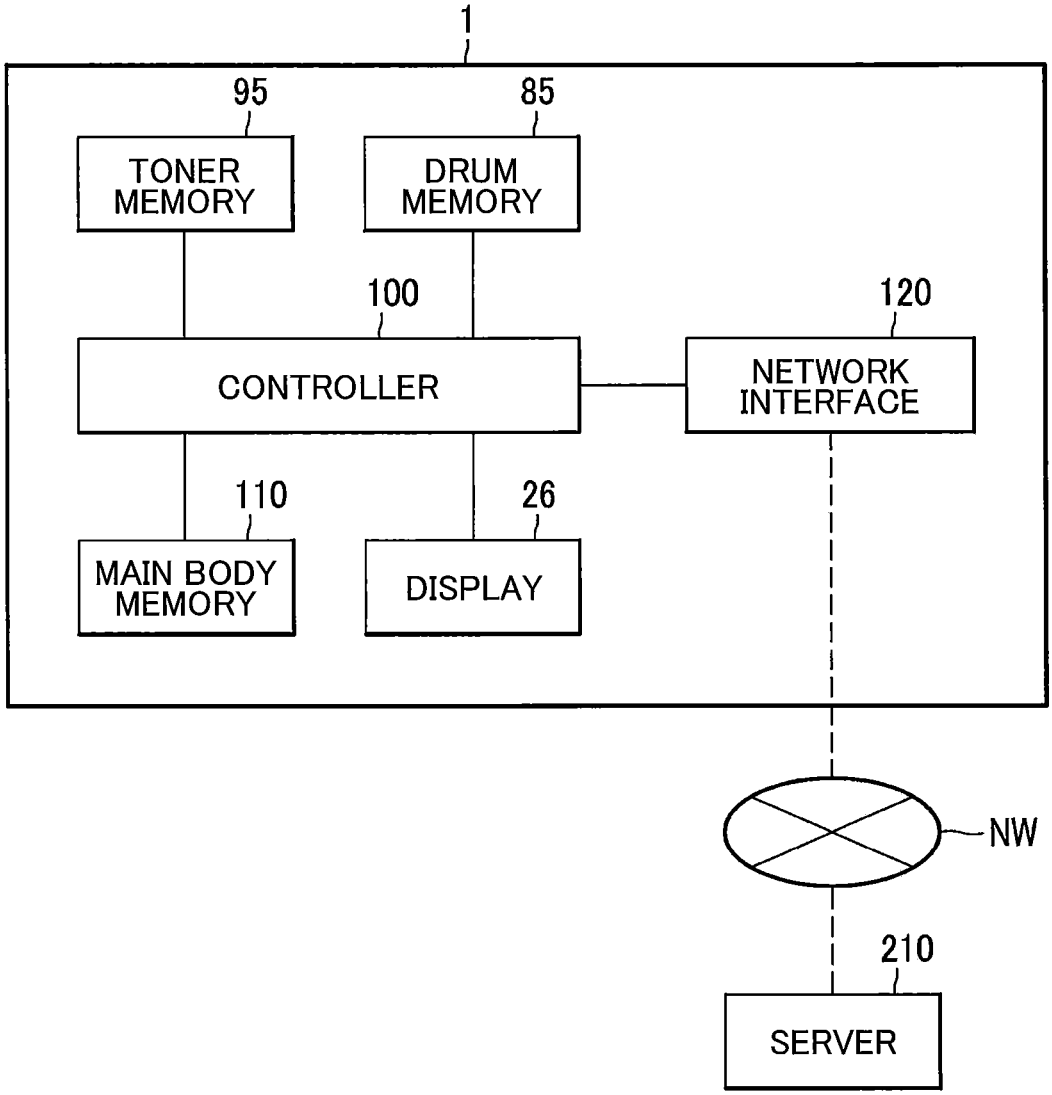
FIG. 3 is a block diagram showing a system according to the embodiment.

The image forming apparatus 1 is provided with a network interface 120 which enables the apparatus 1 to communicate with remote devices through a network NW. The network interface 120 is chips and a circuit board for connection to, for example, a wired-LAN or a wireless-LAN. As shown in FIG. 3, the image forming apparatus 1 is capable of communicating with a server 210 through the network interface 120.

The server 210 is an order receiving server for receiving an order for purchasing consumable items from the controller 100. Specifically, when an order of a toner cartridge 9 is sent from the controller 100 and received at the server 210, the server 210 executes an order receiving process for receiving an order of the toner cartridge 9.

After execution of the order receiving process of the toner cartridge by the server 210, an order acknowledgement information indicating that the toner cartridge 9 is ordered is transmitted to the controller 100 by the server 210. The controller 100 stores an order information in the toner memory 95 based on receiving the order acknowledgement information transmitted from the server 210.

Next, description will be made with respect to the information about the toner cartridge stored in the apparatus body memory 110 or the toner memory 95.

As shown in FIG. 4A, the toner memory 95 is capable of storing: color of toner contained in the toner cartridge 9; cumulative dot count; cumulative number of print sheets; cumulative number of rotations of the developing roller; first flag F1; second flag F2; third flag F3; fourth flag F4; and contractor ID.

The cumulative dot count indicates an accumulated number of dots ever counted through image formation using the toner cartridge 9 attached to the apparatus body 2. The cumulative dot count used for image formation is up-counted by the controller 100 and the cumulative dot count is stored in the toner memory 95.

The cumulative number of rotations of the developing roller 91 indicates a total number of rotations of the developing roller 91 ever rotated for the image formation performed using the toner cartridge 9 attached to the apparatus body 2. The cumulative number of rotations of the developing roller 91 is up-counted by the controller 100 whenever the image formation is performed and the cumulative number of rotations of the developing roller 91 is stored in the toner memory 95.

The cumulative number of print sheets indicates a total number of sheets ever printed using the toner cartridge 9 attached to the apparatus body 2. The cumulative number of print sheets is up-counted by the controller 100 whenever one sheet is printed during image formation and the cumulative number of print sheets is stored in the toner memory 95.

The first flag F1 indicates whether the information about the consumable material is displayed or not displayed on the display. The information about the consumable material indicates that the amount of toner contained in the housing 90 is reduced to a level equal to or less than a first threshold value. The first flag F1 being set to zero (F1=0) indicates that the information about the consumable material is to be displayed whereas the first flag F1 being set to one (F1=1) indicates that the information about the consumable material is not to be displayed. At the time of shipping the image forming apparatus from the manufacturing company, the first flag F1 is set to one.

The second flag F2 differs from the first flag F1. The second flag F2 also indicates whether the information about the consumable material is displayed or not. In the present embodiment, the second flag F2 indicates whether supply contract regarding supply of the toner cartridge 9 is concluded. The second flag F2 being set to zero (F2=0) indicates that the supply contract is not concluded whereas the second flag F2 being set to one (F2=1) indicates that the supply contract is concluded.

The third flag F3 indicates whether an order of a new toner cartridge is made or not. The third flag F3 being set to zero (F3=0) indicates that the next new cartridge is not ordered yet whereas the third flag F3 being set to one (F3=1) indicates that the next new cartridge is ordered. At the time of shipping the image forming apparatus from the manufacturing company, the third flag F3 is set to zero.

The fourth flag F4 indicates whether the toner cartridge 9 having attached to the apparatus body 2 is a new one or a used one. The fourth flag F4 being set to zero (F4=0) indicates that the attached toner cartridge is a used one whereas the fourth flag F4 being set to one (F4=1) indicates that the attached toner cartridge is a new one. At the time of shipping the image forming apparatus from the manufacturing company, the fourth flag F4 is set to one. The controller 100 determines that the toner cartridge 9 having attached to the apparatus body 100 is a new one when the fourth flag F4 in the toner memory 95 is one. On the other hand, the controller 100 determines that the toner cartridge 9 having attached to the apparatus body 100 is a used one if the fourth flag F4 in the toner memory 95 is zero.

The contractor ID is set to zero when the image forming apparatus is shipped from the manufacturing company. The controller 100 makes copy of the contractor ID to the toner memory 95 in a case where the contractor ID is stored in the apparatus body memory 110 and the contractor ID in the toner memory 95 is zero. The contractor ID being zero indicates that the contractor ID is not stored. In order to indicate that the contractor ID is not stored, a vacant character string data or unused specific ID may be stored.

As shown in FIG. 4B, the apparatus body memory 110 is capable of storing a serial number of the toner cartridge 9, third flag F3, and contractor ID.

In the present embodiment, the third flag F3 is stored in both the apparatus body memory 110 and the toner memory 95. When the third flag F3 is changed, the controller 100 changes the contents in both the apparatus body memory 110 and the toner memory 95. It should be noted that in accordance with the present embodiment, the state of the third flag F3 is read from the apparatus body memory 110.

The contractor ID is set to zero when the image forming apparatus is shipped from the manufacturing company. The controller 100 stores a designated contractor ID in the apparatus body memory 110.

Next, description will be made with respect to a process to be executed by the controller 100 after the image forming apparatus 1 is powered.

After the image forming apparatus is powered, the controller 100 repeatedly executes a determination process for determining whether the amount of toner remained in the housing 90 is reduced to a level equal to or less than the first threshold value. The determination process for determining that the amount of toner accommodated in the housing 90 has reduced to a level equal to or less than the first threshold value is executed based on at least one of the cumulative dot count, cumulative number of print sheets, and cumulative number of rotations of the developing roller 91, all data being stored in the toner memory 95. Specifically, the controller 100 counts up the cumulative dot count, cumulative number of print sheets, and cumulative number of rotations of the developing roller as the image formation proceeds and stores the updated values in the apparatus body memory 110. Further, the controller 100 sequentially copies the updated values of the cumulative dot count, cumulative number of print sheets, and cumulative number of rotations of the developing roller 91, all stored in the apparatus body memory 110, into the toner memory 95. The controller 100 sequentially determines whether the cumulative dot count stored in the toner memory 95 reaches a reference value based on the toner amount. The controller 100 sequentially determines whether the cumulative number of print sheets stored in the toner memory 95 reaches the reference value based on the toner amount. Likewise, the controller 100 sequentially determines whether the cumulative number of rotations of the developing roller 91 stored in the toner memory 95 reaches the reference value based on the toner amount. In this manner, the controller 110 sequentially determines whether the amount toner remaining in the housing 90 reaches the first threshold value based on at least one of the cumulative dot count, cumulative number of print sheets, and cumulative number of rotations of the developing roller 91. Determining whether the amount of toner within the housing 90 reaches to the level equal to or less than the first threshold value may be made using a sensor, such as an optical sensor.

Hereinafter, a state in which the amount of toner remaining in the cartridge 9 is determined to be equal to or less than the first threshold value through the determination process will be referred to as "toner low". While it is possible for the image forming apparatus 1 to continuously perform the image formation even though the toner cartridge 9 is determined to be in the "toner low" state, it is desirable that a new toner cartridge 9 be purchase as the remaining amount of toner of the currently using cartridge is getting small. The first threshold value in this embodiment is so set to be the case in which the remaining amount of toner has become 10%.

The controller 100 transmits an order signal to the server 210 through the network interface 120 when the supply contract exists (F2=1), and there is no order information (F3=0) under the condition that the controller 100 determines that the remaining amount of toner in the attached toner cartridge is reduced to be equal to or less than the first threshold value.

When the controller 100 transmits the order signal for ordering a new toner cartridge 9 to the server 210 through the network interface 120, the controller 100 executes a storage control process for storing both in the apparatus body memory 110 and the toner memory 95 the order information, i.e., setting the third flag F3 to one (F3=1), indicating that a new toner cartridge 9 is ordered. In the case where the order information is stored either in the apparatus body memory 110 or in the toner memory 95, the controller 100 controls so that the consumable material information is not to be displayed on the display 26. That is, the controller 100 sets the first flag F1 to zero (F1=0) if the third flag F3 stored either in the apparatus body memory 110 or in the toner memory 95 is one (F3=1).

The controller 100 controls the display 26 to display "toner low" in accordance with the indications of the first flag F1 and the second flag F2 in the case where the remaining amount of toner in the attached toner cartridge 9 is determined to be reduced to a level equal to or less than the first threshold value. Specifically, when the amount of toner accommodated in the housing 90 is reduced to a level equal to or less than the first threshold value, that is, when the "toner low" determination is made, the controller 100 executes the first display control process and the second display control process.

The first display control process is for displaying or not displaying the consumable material information on the display 26 in accordance with the state of the first flag F1 stored in the toner memory 95. The second display control process is for displaying or not displaying the consumable material information on the display 26 in accordance with the state of the second flag F2 stored in the toner memory 95.

The controller 100 determines to be in a "toner empty" state when the remaining amount toner is reduced to a level equal to or less than a second threshold value smaller than the first threshold value. In the "toner empty" state, the controller 100 displays the "toner empty" on the display 26. The state of the "toner empty" refers to a state in which toner in the toner cartridge 9 is vacant (the remaining amount of toner is near zero percent) and thus the toner cartridge 9 has come to the end of life-span.

Next, a cartridge check process will be described which is executed by the controller 100 after the image forming apparatus is powered or a cover 23 is closed.

The controller 100 executes the cartridge check process under an assumption that the toner cartridge 9 may be exchanged after powering the image forming apparatus or closing the cover 23.

The controller 100 reads the second flag F2, the third flag F3, the fourth flag F4, and the contractor ID from the toner memory 95 provided in the toner cartridge 9. The cartridge check process is executed to make determination through the comparison of the third flag F3 and the contractor ID stored in the apparatus body memory 110 with the second flag F2, the third flag F3, the fourth flag F4 and the contractor ID stored in the toner memory 95.

When the controller 100 determines that the second flag F2=1 is not met, and the contractor ID=0 is not met either, that is, when the contractor ID is stored in the toner memory 95 even in a case where the supply contract does not exist, a "cartridge error" is alerted due to inconsistency of the contents of the second flag F2 and the contractor ID. When the controller 100 determines that the second flag F2=1 is not met, the contractor ID=0 is not, and fourth flag F4=1 is met, the controller 100 overwrites the fourth flag F4 from "1" to "0".

When the controller 100 determines that the second flag F2=1 is met, the contractor ID stored in the toner memory 95 and the contractor ID stored in the apparatus body memory 110 are not in coincidence with each other, and the contractor ID=0 is not met, a "cartridge error" is alerted. This situation is such that the toner cartridge attached to another image forming apparatus having a toner cartridge supply contract is attached to the present image forming apparatus 1. When the controller 100 determines that the second flag F2=1, the contractor ID stored in the toner memory 95 and the contractor ID stored in the apparatus body memory 110 are not in coincidence with each other, the contractor ID=0 is met, and the fourth flag F4=1 is not met, a "cartridge error" is alerted. This situation is such that the toner cartridge 9 attached in the past to another image forming apparatus is attached to the present image forming apparatus 1. When the controller 100 determines that second flag F2=1 is met, the contractor ID stored in the toner memory 95 and the contractor ID stored in the apparatus body memory 110 are not in coincidence with each other, the contractor ID=0 is met, and the fourth flag F4=1 is met, the controller 100 writes the contractor ID stored in the apparatus body memory 110 to the toner memory 95.

When the controller 100 determines that the second flag F2=1 is met, the third flag F3=1 in the apparatus body memory 110 is met, the third flag F3=1 in the toner memory 95 is not met, and the fourth flag F4=1 is met, the controller 100 overwrites the fourth flag F4 from "1" to "0". When the controller 100 determines that the second flag F2=1 is met, the third flag F3=1 in the apparatus body memory 110 is met, the third flag F3=1 in the toner memory 95 is not met, and the fourth flag F4=1 is not met, a "cartridge error" is alerted because there is likelihood that the toner cartridge 9 is replaced with another one. When the controller 100 determines that the second flag F2=1 is met, the third flag F3=1 in the apparatus body memory 110 is not met, and the third flag F3=1 in the toner memory 95 is met, a "cartridge error" is alerted because there is likelihood that the toner cartridge 9 is replaced with another one. When the controller 100 determines that the second flag F2=1 is met, the third flag F3=1 in the toner memory 95 is not met, and the third flag F3=1 in the toner memory 95 is not met, and the fourth flag F4=1 is met, notification is made notifying that there is a likelihood that the toner cartridge has not yet finished up.

Description will now be made with respect to a firmware update of the image forming apparatus 1.

Version information of the most recently updated firmware of the image forming apparatus 1 is stored in the memory of a consumable item, such as toner memory 95. When the consumable item is attached to the image forming apparatus 2, the controller 100 reads the version information of the most recently updated firmware from the memory of the consumable item. The controller 100 compares the version information of the firmware stored in the apparatus body memory 110 with that of the firmware read from the memory of the consumable item. When the controller 100 determines that the version information of the firmware stored in the apparatus body memory 110 is older than that of the firmware read from the memory of the consumable item, update of the firmware is implemented.

When updating the firmware of the image forming apparatus 1, the controller 100 displays a message that the firmware will be updated on the display 26, otherwise the message will be notified to the users using their e-mail addresses registered in advance. When receiving the notification that the firmware should be updated, the user may just approve the updating. Alternatively, the update of the firmware may be implemented upon accessing to the manufacture's server to transmit approval. In this case, the controller 100 is configured to perform the accessing thereto automatically.

The message to notify that the firmware will be updated may include contents regarding a functional improvement. For a plurality of functional improvements, the display contents may be changed-over depending upon the version of the apparatus body 2.

The controller 100 stores the firmware version information and the update history in the memory of the consumable item when the update of the firmware is complete.

The controller 100 has a plurality of counter areas including a counter for image formation by the image forming apparatus 1 and a counter regarding functions. A counter for each version of the firmware may further be stored in any area of the plurality of counter areas.

Next, referring to the flowchart illustrated in FIG. 5, description will be made with respect to one example of a process of a new toner cartridge 9 to be executed by the controller 100 during image formation. The controller 100 repeatedly executes the control illustrated in the flowchart of FIG. 5 during image formation.

Figure 5:
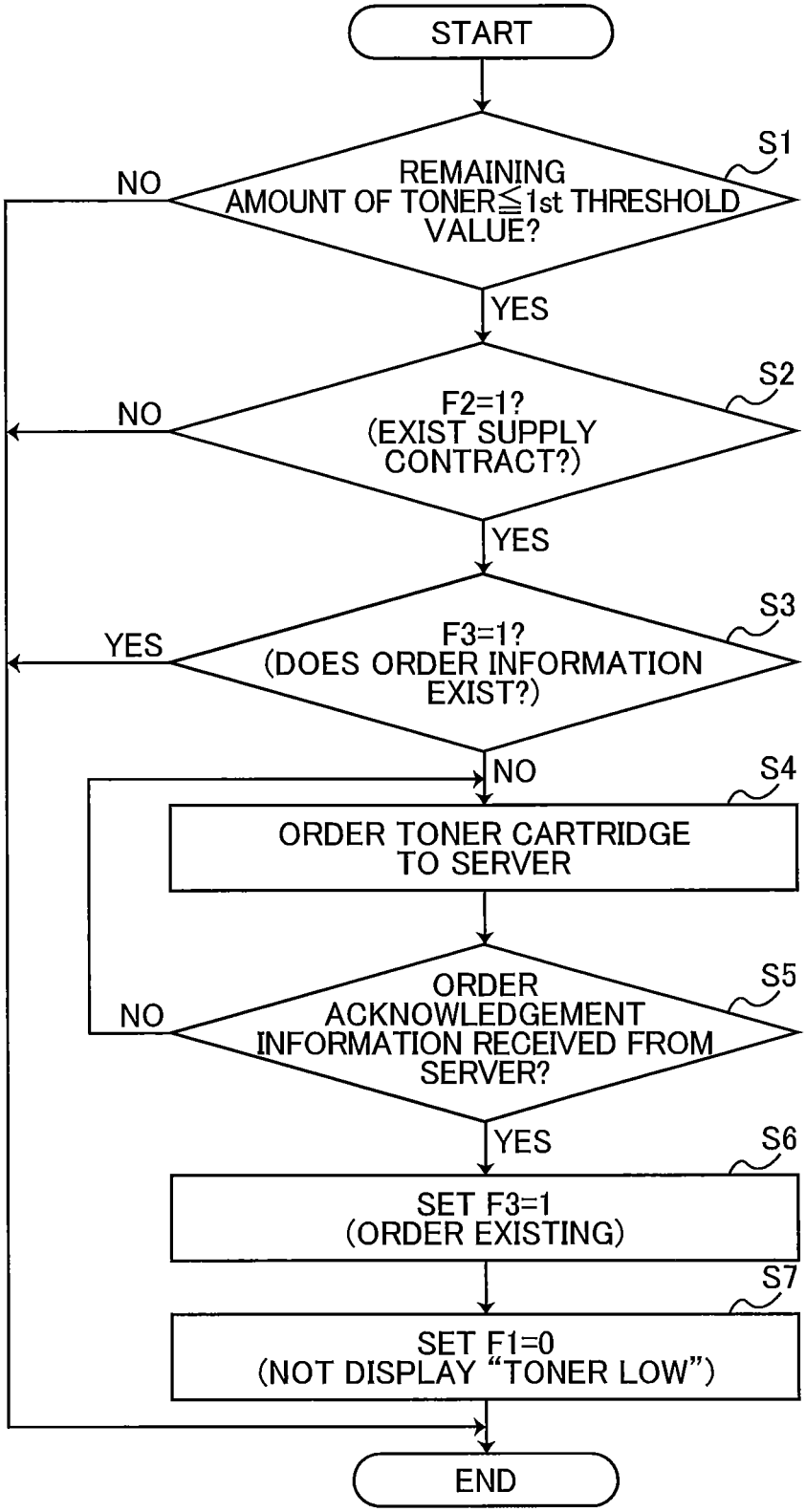
FIG. 5 is a flowchart illustrating one example of a display process executed by a controller.

As shown in FIG. 5, the controller 100 determines that the remaining amount of toner is equal to or less than the first threshold value (S1). When the controller 100 determines that the remaining amount of toner does not yet reach the level equal to or less than the first threshold value (S1: NO), the routine is ended because an order of a new toner cartridge is not needed. When the controller 100 determines that the remaining amount of toner has reached the level equal to or less than the first threshold value (S1: YES), the controller determines whether the second flag F2 is set to one (F2=1) (S2).

When the controller 100 determines that the second flag F2 is not set to one (S2: NO), the routine is ended because the supply contract of the toner cartridge 9 does not exist. When the controller 100 determines that the second flag F2 is set to one (F2=1) (S2: YES), the controller determines whether the third flag F3 is set to one (F3=1) (S3).

When the controller 100 determines that the third flag F3 is set to one (F3=1) (S3: YES), the routine is ended. Because the order information exists, no further new toner cartridge does not need to be ordered. When the controller 100 determines that the third flag F3 is not set to one (S2: NO), a toner cartridge 9 is ordered to the server 210 (S4).

After execution of S4, the controller 100 determines whether order acknowledgement information is received from the server 210 (S5). When the controller 100 determines that the order acknowledgement information is not received from the server 210 (S6: NO), the routine returns to S4. When the controller 100 determines that the order acknowledgement information is received from the server 210 (S6: YES), the third flag F3 is set to one (F3=1) (S6), and the first flag F1 is set to zero (F1=0) (S7), whereupon the routine is ended.

Next, referring to the flowchart illustrated in FIG. 6, description will be made with respect to a "toner low" display process to be executed during image formation. The controller 100 repeatedly executes the control illustrated in the flowchart of FIG. 6 during image formation.

Figure 6:
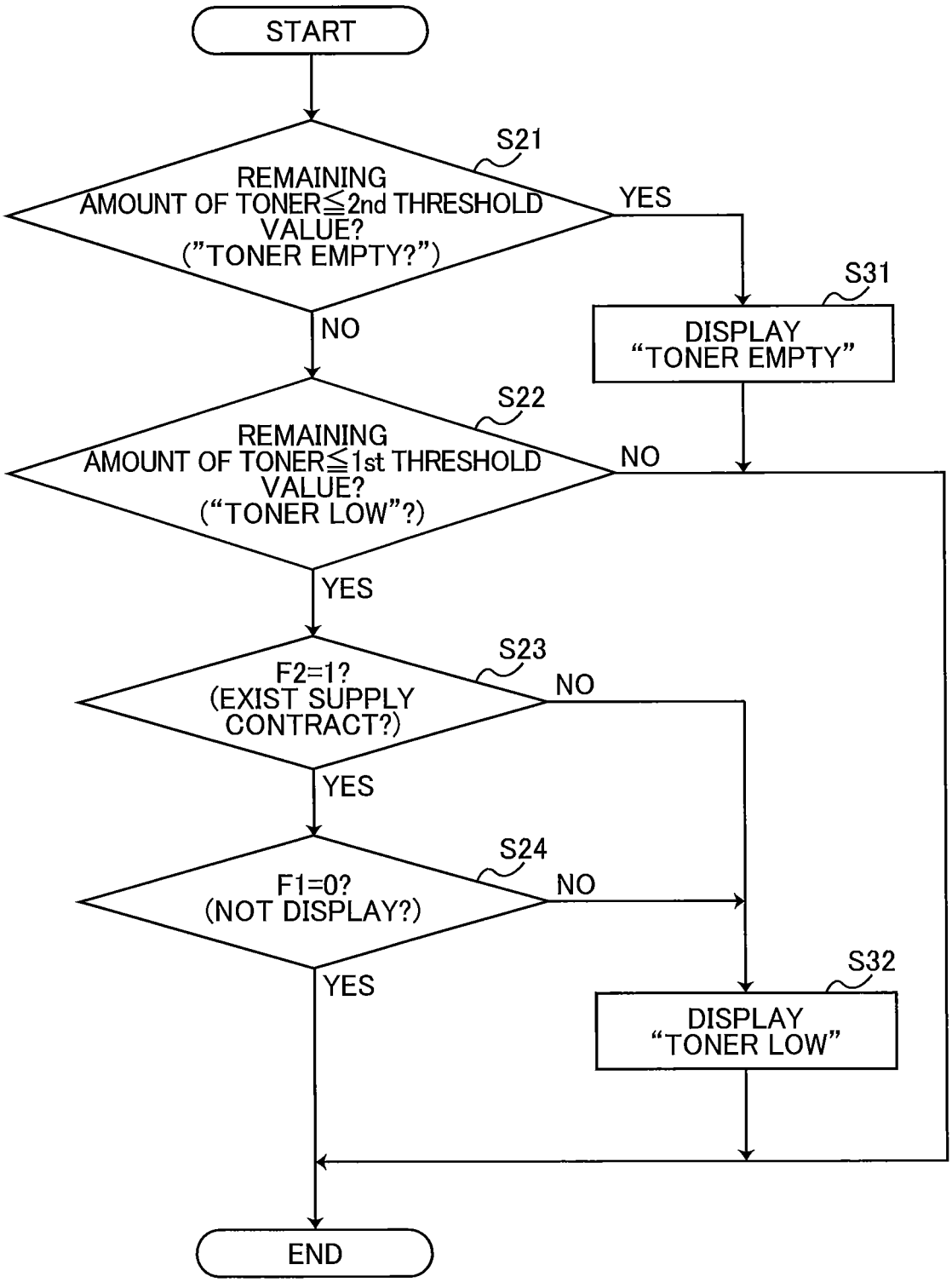
FIG. 6 is a flowchart illustrating one example of an ordering process executed by the controller.

As illustrated in FIG. 6, the controller 100 determines whether the remaining amount of toner is reduced to a level equal to or less than the second threshold value (S21). When the controller 100 determines that the remaining amount of toner has reduced a level equal to or less than the second threshold value (S21: YES), a message of "toner empty" is displayed on the display 26 (S31) and the routine is ended. When the controller 100 determines that the remaining amount of toner has not yet reduced to a level equal to or less than the second threshold value (S21: NO), the controller further determines whether the remaining amount of toner has reduced to a level equal to or less than the first threshold value (S22).

When the controller 100 determines that the remaining amount of toner is not yet reduced the level equal to or less than the first threshold value (S22: NO), the routine is ended. This is because the display relating to the remaining amount of toner is not needed. Under this situation, the controller 100 does not display "toner low" on the display 26. When the controller 100 determines that the remaining amount of toner reduces to a level equal to or less than the first threshold level (S22: YES), the controller 100 determines whether the second flag F2 is set to one (F2=1) (S23).

When the controller 100 determines that the second flag F2 is not set to one (S23: NO), the routine is ended with displaying "toner low" on the display 26 (S32). When the controller 100 determines that the second flag F2 is set to one (F2=1) (S23: YES), the controller 100 further determines whether the first flag F1 is set to zero (F1=0) (S24).

When the controller 100 determines that the first flag is not set to zero (S24: NO), the routine is ended with displaying "toner low" on the display 26 (S32). When the controller 100 determines that the first flag F1 is set to zero (F1=0) (S24: YES), the routine is ended. At this time, the controller 100 does not display "toner low" on the display 26.

Next, referring to the flowcharts illustrated in FIGS. 7 through 9, description will be made with respect to a cartridge check process to be executed by the controller 100 during image formation.

Figure 7:
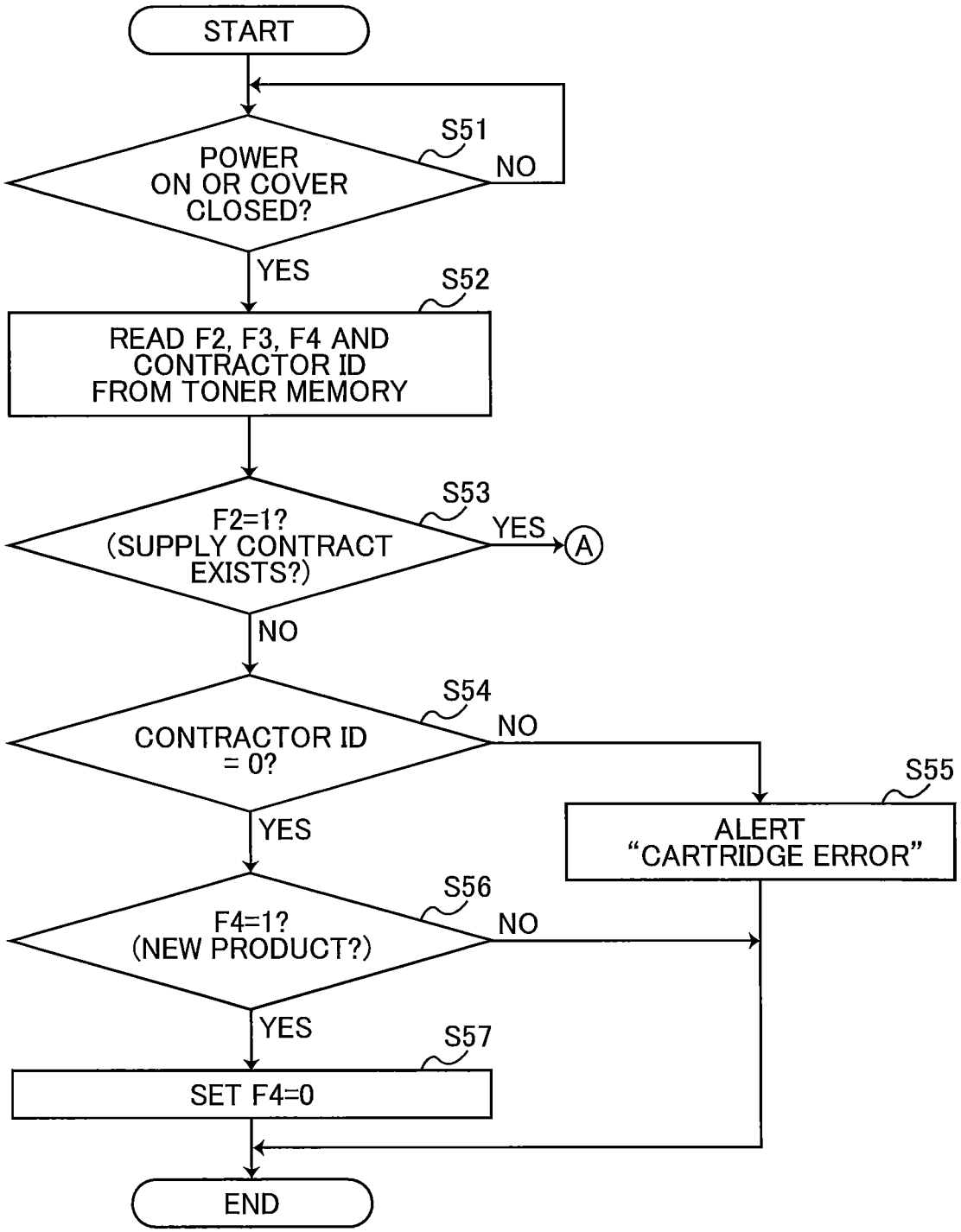
FIG. 7 is a part of a flowchart illustrating one example of a cartridge check process executed by the controller.
Figure 8:
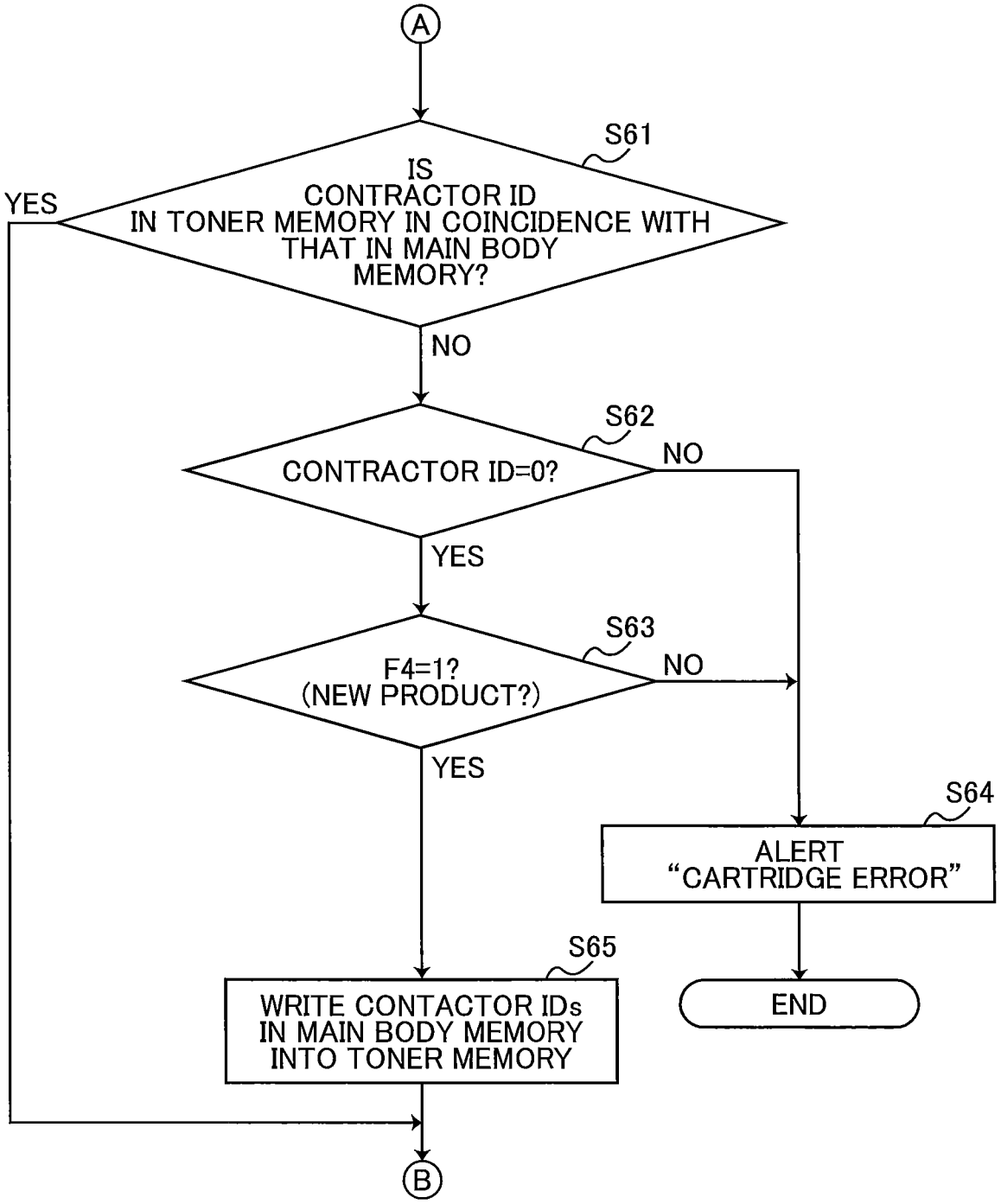
FIG. 8 is a remaining part of the flow chart continued from the flowchart shown in FIG. 7.

As illustrated in FIG. 7, the controller 100 determines whether the apparatus is power ON or the cover 23 is closed (S51). When the controller 100 determines in S51 that neither the apparatus is power ON nor the cover 23 is closed (S51: NO), the controller 100 waits until the apparatus is turned to power ON or the cover is closed.

When the controller determines in S51 that the apparatus is turned to power ON or the cover 23 is closed (S51: YES), the controller 100 reads from the toner memory 95 the second flag F2, third flag F3, fourth flag F4 and contractor ID (S52) and determines whether the second flag F2 is set to one (F2=1) indicating whether there exists a supply contract (S53).

When the controller 100 determines in S53 that the second flag is not set to one (S53: NO), the controller 100 further determines whether the contractor ID is set to zero (S54).

When the controller 100 determines in S54 that the contractor ID is not set to zero (S54: NO), an alert of "cartridge error" is issued (S55). This is because the contractor ID is stored in the toner memory 95 although the supply contract does not exist. There is inconsistency between what is indicated by the second flag F2 and what is indicated by the contactor ID. When the controller 100 determines in S54 that the contractor ID is set to zero (S54: YES), the controller 100 further determines whether the fourth flag F4 is set to one (F4=1) (S56).

When the controller 100 determines in S56 that the fourth flag F4 is not set to one (S56: NO), the routine is ended. When the controller 100 determines in S56 that the fourth flag F4 is set to one (S56: YES), the routine is ended with setting the fourth flag F4 to zero (F4=0) (S57), because the situation is such that the currently using toner cartridge is replaced with a new one despite no supply contract.

When the controller 100 determines in S53 that the second flag F2 is set to one (F2=1) (S53: YES), the controller further determines, as shown in FIG. 8, whether the contractor IDs in the toner memory 95 and in the apparatus body memory 110 are in coincidence with each other (S61). When the controller 100 determines in S61 that the contractor IDs in the toner memory 95 and in the apparatus body memory 110 are not in coincidence with each other (S61: NO), the controller 100 further determines whether the contractor ID is set to zero (S62).

When the controller 100 determines in S62 that the contractor ID is not set to zero (S62: NO), the contractor ID stored in the apparatus body memory 110 is different from that stored in the toner memory 95. In such a situation, an alert of "cartridge error" is issued (S64), because the toner cartridge attached to another image forming apparatus having a toner cartridge supply contract is attached to the present image forming apparatus 1. When the controller 100 determines in S62 that the contractor ID is set to zero (S62: YES), the controller 100 further determines whether the fourth flag F4 is set to one (F4=1) (S63).

When the controller 100 determines in S63 that the fourth flag F4 is not set to one (S63: NO), an alert of "cartridge error" is issued (S64). This situation is such that the toner cartridge 9 attached in the past to another image forming apparatus is attached to the present image forming apparatus. When the controller 100 determines in S63 that the fourth flag F4 is set to one (F4=1) (S63: YES) indicates that the supply contract exists and the new toner cartridge is attached. As such, the contract ID stored in the apparatus body memory 110 is written in the toner memory 95.

Figure 9:
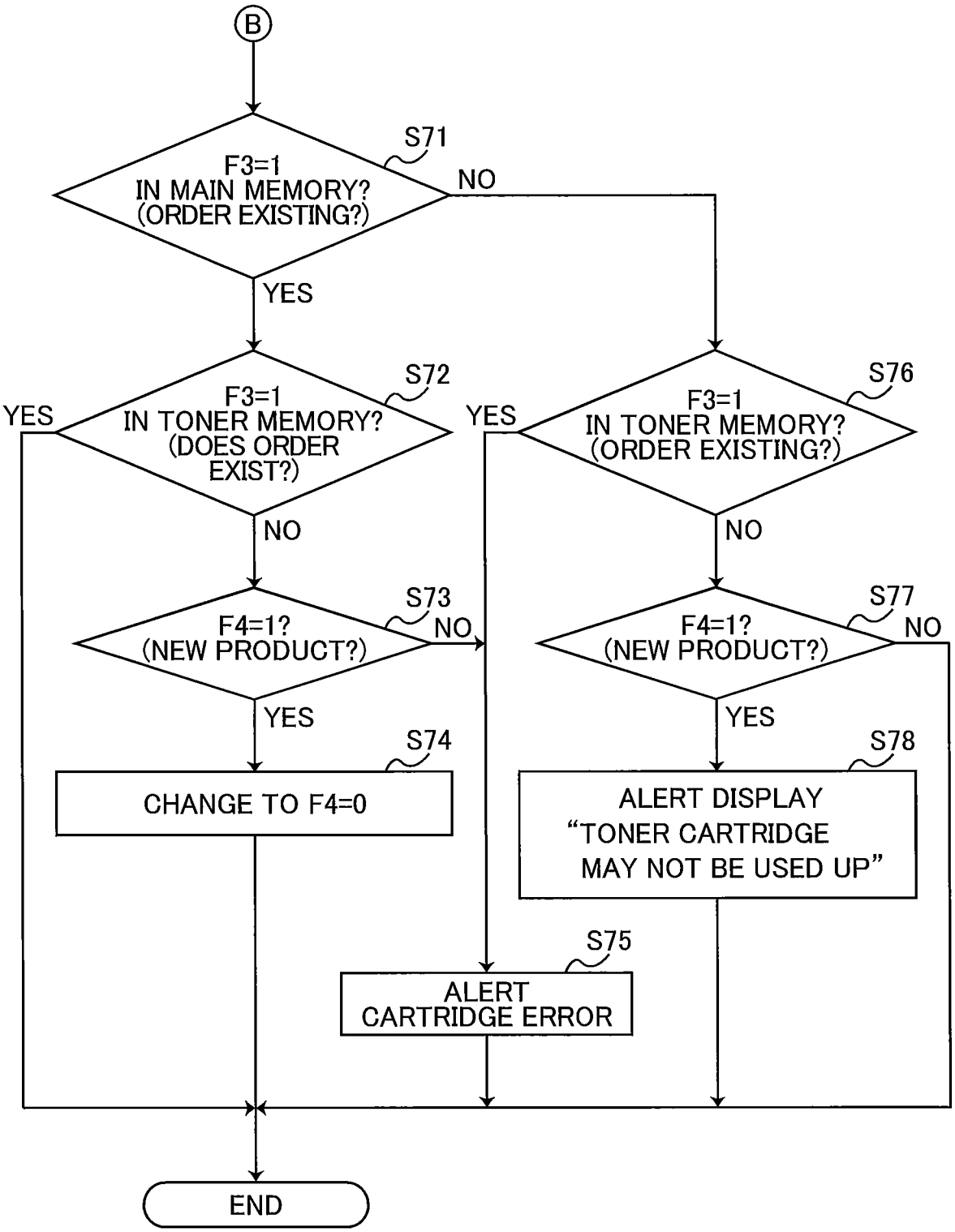
FIG. 9 is a remaining part of the flow chart continued from the flowchart shown in FIG. 8.

As shown in FIG. 9, after determination in S61 that the contractor IDs stored in the toner memory 95 and in the apparatus body memory 110 are not in coincidence with each other (S61: YES) and S65, the controller 100 further determines whether the third flag F3 stored in the apparatus body memory 110 is one (F3=1) (S71).

When the controller 100 determines in S71 that the third flag F3 stored in the apparatus body memory 110 is set to one (F3=1) (S71: YES), the controller 100 further determines whether the third flag F3 stored in the toner memory 95 is set to one (F3=1) (S72). When the controller 100 determines in S72 that the third flag F3 stored in the toner memory 95 is set to one (F3=1) (S72: YES), the routine is ended. When the controller 100 determines in S72 that the third flag F3 stored in the toner memory 95 is not set to one (S72: NO), the controller 100 further determines whether the fourth flag F4 is set to one (F4=1) (S73).

When the controller 100 determines in S73 that the fourth flag F4 is set to one (F4=1) (S73: YES) indicates that the supply contract exists and a new toner cartridge delivered to the user after submitting the supply order of the toner cartridge is attached to the apparatus. Accordingly, the routine is ended with setting the fourth flag F4 to zero (F4=0) (S74). When the controller determines in S73 that the fourth flag F4 is not set to one (S73: NO) indicates that there is a likelihood that the toner cartridge 9 is replaced with another one, so an alert of "cartridge error" is displayed (S75).

When the controller 100 determines in S71 that the third flag F3 stored in the apparatus body memory 110 is not set to one (S71: NO), the controller 100 further determines whether the third flag F3 stored in the toner memory 95 is set to one (F3=1) (S76).

When the controller 100 determines in S76 that the third flag F3 stored in the toner memory 95 is set to one (F3=1) (S78: YES) indicates that there is a likelihood that the toner cartridge 9 may be replaced with another one, so an alert of "cartridge error" is displayed (S75). When the controller 100 determines in S76 that the third flag F3 stored in the toner memory 95 is not set to one (S78: NO), further determination is made as to whether the fourth flag F is set to one (F4=1) (S77).

When the controller 100 determines in S77 that the fourth flag F4 is not set to one (S77: NO) indicates that the toner cartridge that is not a new one has been used, so the routine is ended. When the controller 100 determines in S77 that the fourth flag F4 is set to one (F4=1) (S73: YES) indicates that a new toner cartridge is attached with no new toner cartridge supply order. In this situation, a message is displayed alerting "toner cartridge may not be used up" (S78).

As described above, the image forming apparatus according to the above-described embodiment has the following advantages.

In the conventional image forming apparatus of the type in which a new toner cartridge is automatically purchase ordered and delivered to the user, some users consider it to be not advisable that the currently using cartridge is replaced with a new cartridge even though the currently using consumable cartridge is not finished up.

In accordance with the image forming apparatus 1 of the present disclosure, when the remaining amount of toner contained in a toner cartridge is reduced to a level equal to or less than the first threshold value, the first display control process is executed. With this process, consumable material information is either displayed on the display 26 or not displayed thereon in accordance with the status of the first flag F1 stored in the toner memory 95. The displayed information notifies that the remaining amount of toner has reduced to a level equal to or less than the first threshold value. More specifically, the controller 100 does not perform the "toner low" display in the case where the purchase order information representing that a new toner cartridge 9 is ordered is stored in the apparatus body memory 110 or the toner memory 95. In this manner, whether information about the amount of toner remaining in the housing 90 is to be displayed or not to be displayed can be determined on a toner cartridge basis. Consequently, the toner cartridge 9 can be used up to vacant and thus replacing the toner cartridge not having used up the toner with a new one can be prevented from occurring.

Further, the controller 100 executes the second display control process in which the consumable material information is either displayed on the display 26 or not displayed thereon in accordance with not only the first flag F1 but also the second flag F2 different from the first flag F1. The displayed information notifies the user that the remaining amount of toner contained in the toner cartridge is reduced to a level equal to or less than the first threshold value. As such, the second display control process can be executed in accordance with conditions different from those to change over the status of the first flag F1.

While the description has been made in detail with reference to the embodiment, it would be apparent to those skilled in the art that many modifications and variations may be made thereto as will be described below.

While the above-described embodiment is directed to the toner cartridge exemplified as a consumable cartridge, other consumable item containing produce may be a drum cartridge, ink cartridge, tape cassette. The ink cartridge, for example, contains ink as a consumable material. The tape cassette has a tape as a consumable material.

In the above-described embodiment, the status of the third flag F3 being set to one (F3=1) is stored in both the apparatus body memory 110 and the toner memory 95 when a signal for ordering a new toner cartridge is transmitted to the server 210. This can be modified so that the controller 100 may store the third flag F3 being set to one (F3=1) in either one of the apparatus body memory 110 and the toner memory 95.

While the above-described embodiment describes that the developing cartridge is detachably attached to the apparatus body together with the drum cartridge attached to the developing cartridge, the developing cartridge may solely be detachably attached to the apparatus body. In this case, the developing cartridge and the drum cartridge are separately and solely be attached to and detached from the apparatus body.

The above-described embodiment describes a monochromatic laser printer as an example of an image forming apparatus. The image forming apparatus may be a color laser printer, copying machine and multi-function apparatus.

The elements described in conjunction with the above-described embodiment and the modifications may be combined and practiced on an as-needed basis.

While the description has been made in detail with reference to the specific embodiment, it would be apparent to those skilled in the art that various changes and modifications may be made without departing from the scope of the disclosure.

What is claimed is:

1. An image forming apparatus comprising:

an apparatus body;

a display;

a consumable cartridge attached to the apparatus body comprising:

a housing accommodating consumable material therein for use in image formation; and a consumable product memory storing a first flag, the first flag indicating whether consumable material information indicating that an amount of the consumable material is reduced to a level equal to or less than a first threshold value is displayed or not displayed on the display; and a controller configured to execute a first display process for determining whether the consumable material information is displayed on the display in accordance with indication of the first flag stored in the consumable product memory.

2. The image forming apparatus according to claim 1, wherein the first display process is executed when the controller determines that the amount of the consumable material is reduced to the level equal to or less than a first threshold value.

3. The image forming apparatus according to claim 2, wherein the controller stores in the consumable product memory at least one of a cumulative dot count indicating an accumulated number of dots ever printed for image formation using the cartridge attached to the apparatus body and a cumulative number of print sheets indicating an accumulated number of print sheets ever printed using the cartridge attached to the apparatus body, and wherein the controller is configured to further executes a determination process for determining that the amount of consumable material accommodated in the housing reduces to the level equal to or less than the first threshold value based on at least one of the cumulative dot count and the cumulative number of print sheets stored in the consumable product memory.

4. The image forming apparatus according to claim 1, wherein the consumable product memory further stores a second flag different from the first flag, and wherein the controller is further configured to execute a second display process for determining whether the consumable material information is displayed on the display in accordance with indication of the second flag stored in the consumable product memory.

5. The image forming apparatus according to claim 4, wherein the second flag indicates whether a contract on a supply of a new cartridge exists or not.

6. The image forming apparatus according to claim 1, further comprising an apparatus body memory, wherein the controller is configured to further execute a storing control process for storing in at least one of the apparatus body memory and the consumable product memory order information indicating that a new cartridge is ordered, and wherein in a case where the order information is stored in at least one of the apparatus body memory and the consumable product memory, the first flag is set so that the consumable material information is not displayed on the display.

7. The image forming apparatus according to claim 6, further comprising a network interface, wherein the controller is configured to further execute storing the order information in at least one of the apparatus body memory and the consumable product memory in response to receipt of order acknowledgement information indicating that an order of a new cartridge is received from a server communicable through the network interface.

8. The image forming apparatus according to claim 1, wherein the consumable material is toner, and the cartridge is a toner cartridge.

9. The image forming apparatus according to claim 8, wherein the toner cartridge includes a developing roller.

10. The image forming apparatus according to claim 9, wherein the controller stores in the consumable product memory at least one of a cumulative dot count indicating an accumulated number of dots ever printed for image formation using the cartridge attached to the apparatus body, a cumulative number of print sheets indicating an accumulated number of print sheets ever printed using the cartridge attached to the apparatus body, and a cumulative number of rotations of the developing roller indicating a number of rotations of the developing roller ever rotated for image formation using the cartridge attached to the apparatus body, and wherein the controller is configured to further execute a second determination process for determining that the amount of consumable material accommodated in the housing reduces to the level equal to or less than the first threshold value based on at least one of the cumulative dot count, the cumulative number of print sheets, and the cumulative number of rotations of the developing roller stored in the consumable product memory.

* * * * *